US010118812B2

(12) United States Patent
Ochipa

(10) Patent No.: US 10,118,812 B2
(45) Date of Patent: Nov. 6, 2018

(54) HANGER SYSTEM WITH INTEGRATED BOTTLE OPENER

(71) Applicant: S9, LLC, Fort Myers, FL (US)

(72) Inventor: Matthew Ochipa, Hollywood, FL (US)

(73) Assignee: S9, LLC, Fort Myers, FL (US)

( * ) Notice: Subject to any disclaimer, the term of this patent is extended or adjusted under 35 U.S.C. 154(b) by 357 days.

(21) Appl. No.: 15/009,631

(22) Filed: Jan. 28, 2016

(65) Prior Publication Data

US 2016/0223137 A1 Aug. 4, 2016

Related U.S. Application Data

(60) Provisional application No. 62/110,940, filed on Feb. 2, 2015.

(51) Int. Cl.
*B67B 7/16* (2006.01)
*A47G 25/00* (2006.01)
(Continued)

(52) U.S. Cl.
CPC ..... *B67B 7/16* (2013.01); *A47G 25/005* (2013.01); *A47G 25/28* (2013.01); *A47G 25/32* (2013.01); *A47G 25/4015* (2013.01); *A47G 25/4046* (2013.01); *A47G 25/4053* (2013.01); *A47G 25/482* (2013.01)

(58) Field of Classification Search
CPC ..... B67B 7/16; F16M 13/06; F16M 13/02; A47G 25/005; A47G 25/32; A47G 25/482; A47G 25/0657; A47G 25/08; A47G 25/14; A47G 2025/1492; A47G 25/16; A47G 25/18; A47G 25/183; A47G 25/186; A47G 25/28; A47G 25/34; A47G 25/40; A47G 25/4015; A47G 25/4023; A47G 25/4038; A47G 25/4046; A47G 25/4053; A47G 25/4069; A47G 25/441; A47G 25/44; A47G 25/447; A47G 25/48; A47G 25/50; A47G 25/60; A47G 25/743; A47G 25/90
USPC ..... 211/85.3, 113, 195; 81/3.55, 3.4, 3.29, 81/3.27, 3.08, 3.07, 3.57, 3.15, 3.25, 3.32, 81/3.31; D8/38, 18, 33, 34, 37, 39, 40, D8/19
See application file for complete search history.

(56) References Cited

U.S. PATENT DOCUMENTS 1,552,376 A * 9/1925 Allen ..... A47G 25/28 223/88
1,689,373 A * 10/1928 Weinberg ..... A47G 25/28 223/92

(Continued)

*Primary Examiner* — Jennifer E. Novosad
(74) *Attorney, Agent, or Firm* — Craig R. Miles; CR MILES P.C.

(57) ABSTRACT

A hanger system including a body having opposing body first and second faces; a hanger element coupled to the body, the hanger element configured to facilitate hanging of the hanger system; a first support element coupled to the body, the first support element configured to support a first article; and an aperture element disposed within the body, the aperture element having an aperture element edge defining an aperture element opening which communicates between the body first and second faces; whereby the aperture element opening is configured to receive at least a portion of a bottle cap removably coupled to a bottle; and whereby the aperture element edge is configured to engage the bottle cap to facilitate removal of the bottle cap from the bottle.

18 Claims, 19 Drawing Sheets

(51) Int. Cl.

| | |
|---|---|
| ***A47G 25/28*** | (2006.01) |
| ***A47G 25/32*** | (2006.01) |
| ***A47G 25/40*** | (2006.01) |
| ***A47G 25/48*** | (2006.01) |

(56) References Cited

U.S. PATENT DOCUMENTS 1,783,709 A * 12/1930 Goldberg ..... A47G 25/28 223/88
2,271,901 A * 2/1942 Smith ..... B65G 7/12 220/737
2,478,590 A * 8/1949 McKnelly ..... A47G 25/4038 137/512.2
2,840,284 A * 6/1958 Howell ..... A47G 25/28 223/95
4,300,688 A * 11/1981 London ..... A47G 25/36 206/285
4,669,642 A * 6/1987 Nicholas ..... A47G 25/14 211/118
4,717,053 A * 1/1988 Wang ..... A47G 25/4053 211/118
4,795,121 A * 1/1989 Comito ..... F21S 4/10 211/26
4,967,622 A * 11/1990 Phillips ..... B67B 7/44 7/151
5,085,357 A * 2/1992 Chen ..... A47G 25/4038 223/85
5,114,017 A * 5/1992 Doyel ..... A47F 7/08 211/118
5,314,160 A * 5/1994 Larsen ..... A47G 1/20 248/489
5,375,726 A * 12/1994 Lechleiter ..... B65D 71/50 211/60.1
5,417,352 A * 5/1995 Jen ..... A47G 25/32 223/85
5,520,311 A * 5/1996 Lam ..... A47G 25/20 223/85
5,538,166 A * 7/1996 Ogawa ..... A47G 25/28 223/85
D382,784 S * 8/1997 Kagiyama ..... 81/3.55
D383,954 S * 9/1997 Biunno ..... D8/38
5,664,669 A * 9/1997 VanFleet ..... A47F 5/0006 206/459.5
5,778,556 A * 7/1998 Ohsugi ..... A43D 3/1408 211/34
5,938,160 A * 8/1999 Hartmann ..... B60N 3/103 224/926
5,946,753 A * 9/1999 Roberts ..... B67B 7/16 30/113
6,076,716 A * 6/2000 Reyes ..... A47G 25/32 223/94
6,360,899 B1 * 3/2002 Smith ..... B29C 45/2701 206/420
D488,689 S * 4/2004 Smith, IV ..... D8/18
D488,974 S * 4/2004 Kelleghan ..... D8/38
D555,447 S * 11/2007 Bhavnani ..... D8/34
D633,351 S * 3/2011 Welch ..... D8/18
D658,463 S * 5/2012 Welch ..... D8/18
D741,674 S * 10/2015 Seiders ..... D8/34
D800,524 S * 10/2017 Weiss ..... D8/34
D811,837 S * 3/2018 Brandes ..... D8/18
2003/0159545 A1 * 8/2003 Teppe ..... B67B 7/16 81/3.07
2008/0290121 A1 * 11/2008 Wise ..... A43B 3/0031 223/113
2011/0068066 A1 * 3/2011 Dushey ..... A47F 5/0006 211/59.2
2013/0206797 A1 * 8/2013 Ivoska ..... A47G 25/005 223/84
2015/0028066 A1 * 1/2015 Zechini ..... A47G 25/441 223/85
2015/0162712 A1 * 6/2015 Yan ..... B67B 7/16 439/501
2015/0231014 A1 * 8/2015 Capobianco ..... B25F 1/00 601/135
2016/0223137 A1 * 8/2016 Ochipa ..... B67B 7/16
2017/0000278 A1 * 1/2017 Hansen ..... A47G 25/40

* cited by examiner

HANGER SYSTEM WITH INTEGRATED BOTTLE OPENER

This United States Non-Provisional Patent Application claims the benefit of U.S. Provisional Patent Application No. 62/110,940, filed Feb. 2, 2015, hereby incorporated by reference herein.

SUMMARY OF THE INVENTION

A broad object of a particular embodiments of the invention can be to provide a hanger system, and methods of making and using such a hanger system, whereby the hanger system includes a body having opposing body first and second faces; a hanger element coupled to the body, the hanger element configured to facilitate hanging of the hanger system; a first support element coupled to the body, the first support element configured to support a first article; and an aperture element disposed within the body, the aperture element having an aperture element edge defining an aperture element opening which communicates between the body first and second faces; whereby the aperture element opening is configured to receive at least a portion of a bottle cap removably coupled to a bottle; and whereby the aperture element edge is configured to engage the bottle cap to facilitate removal of the bottle cap from the bottle.

Naturally, further objects of the invention are disclosed throughout other areas of the specification, drawings, and claims.

A BRIEF DESCRIPTION OF THE DRAWINGS

Figure 13:
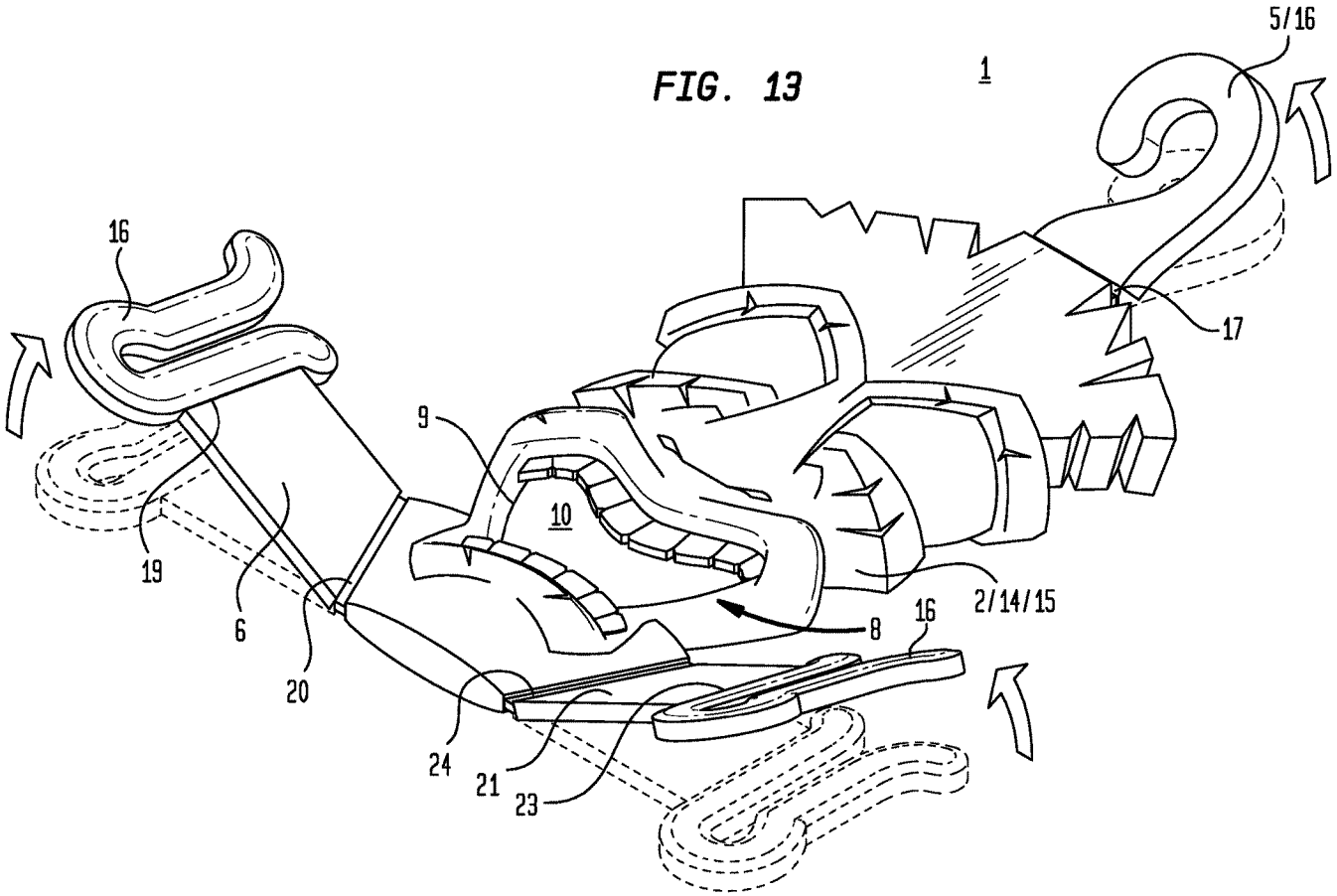

FIG. 13 is a perspective view of a particular embodiment of the hanger system, whereby a hanger element, a first support element, and a second support element are each removably coupled to a body of the hanger system and can be rotated about a corresponding hanger element junction, first support element junction, and second support element junction; and whereby the body of the hanger element is configured as the head of Tiki.

Figure 14:
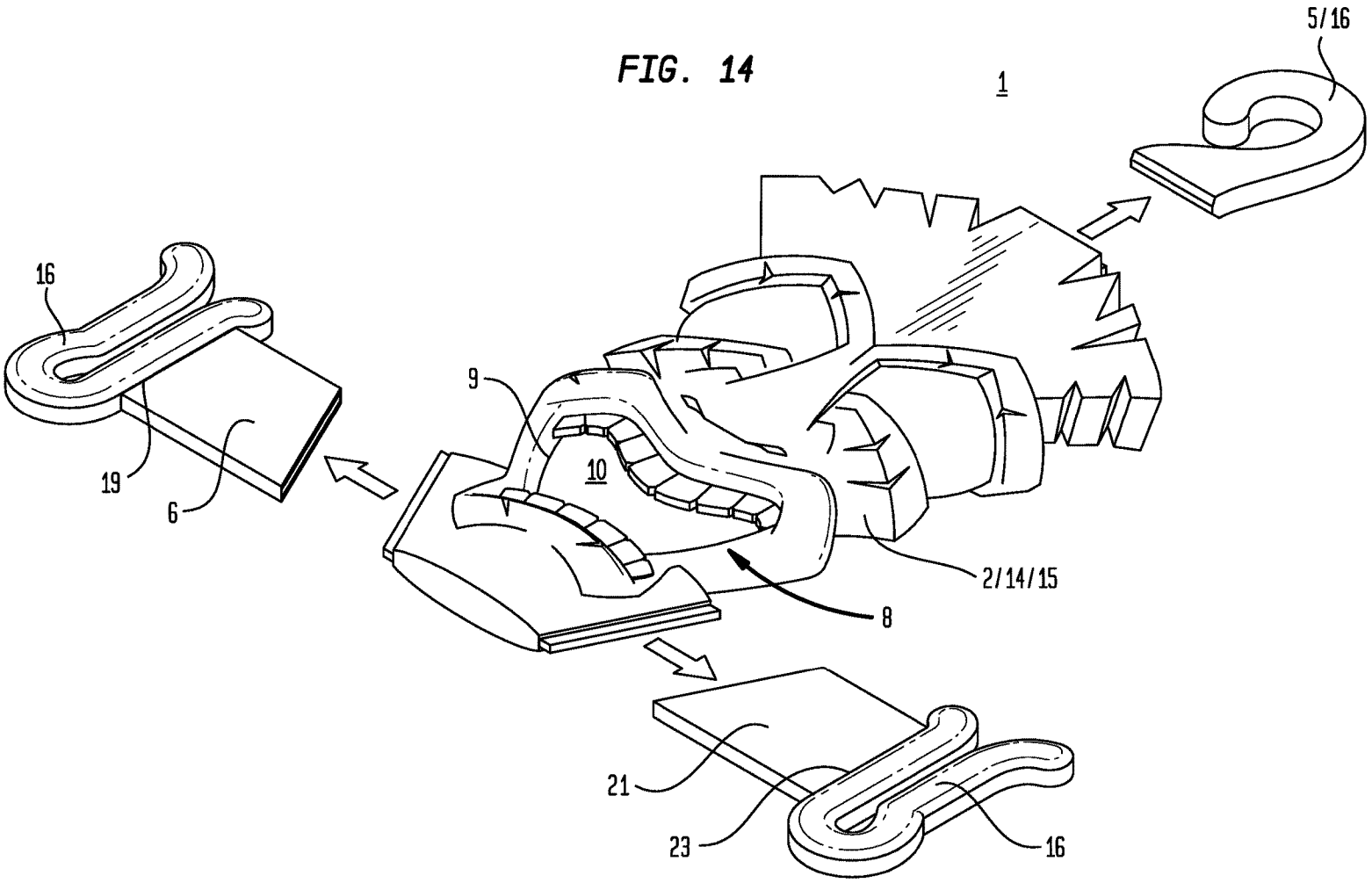

FIG. 14 is a perspective view of the particular embodiment of the hanger system shown in FIG. 13, whereby following rotation about the corresponding hanger element junction, first support element junction, and second support element junction, the hanger element, the first support element, and the second support element are uncoupled from the body.

Figure 15:
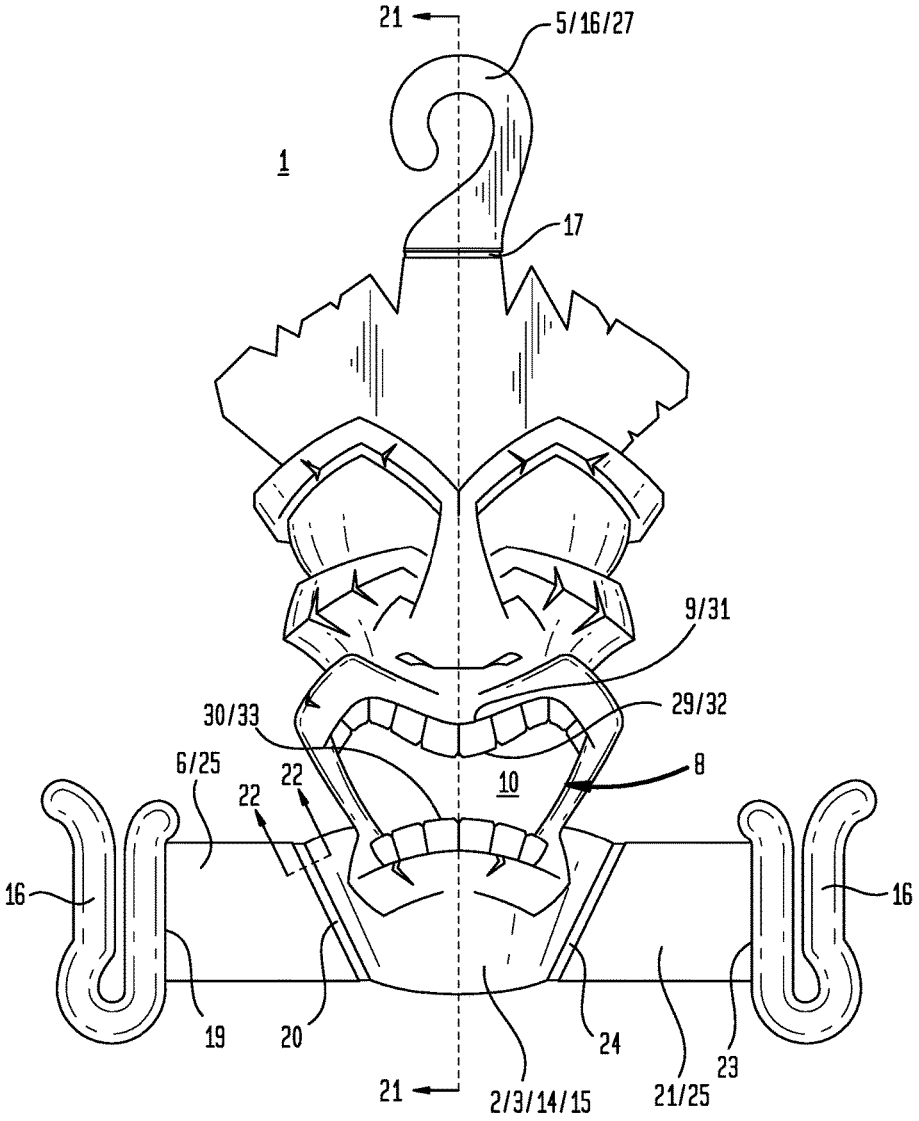

FIG. 15 is a front view of a particular embodiment of the hanger system, whereby a body of the hanger element is configured as the head of Tiki.

Figure 16:
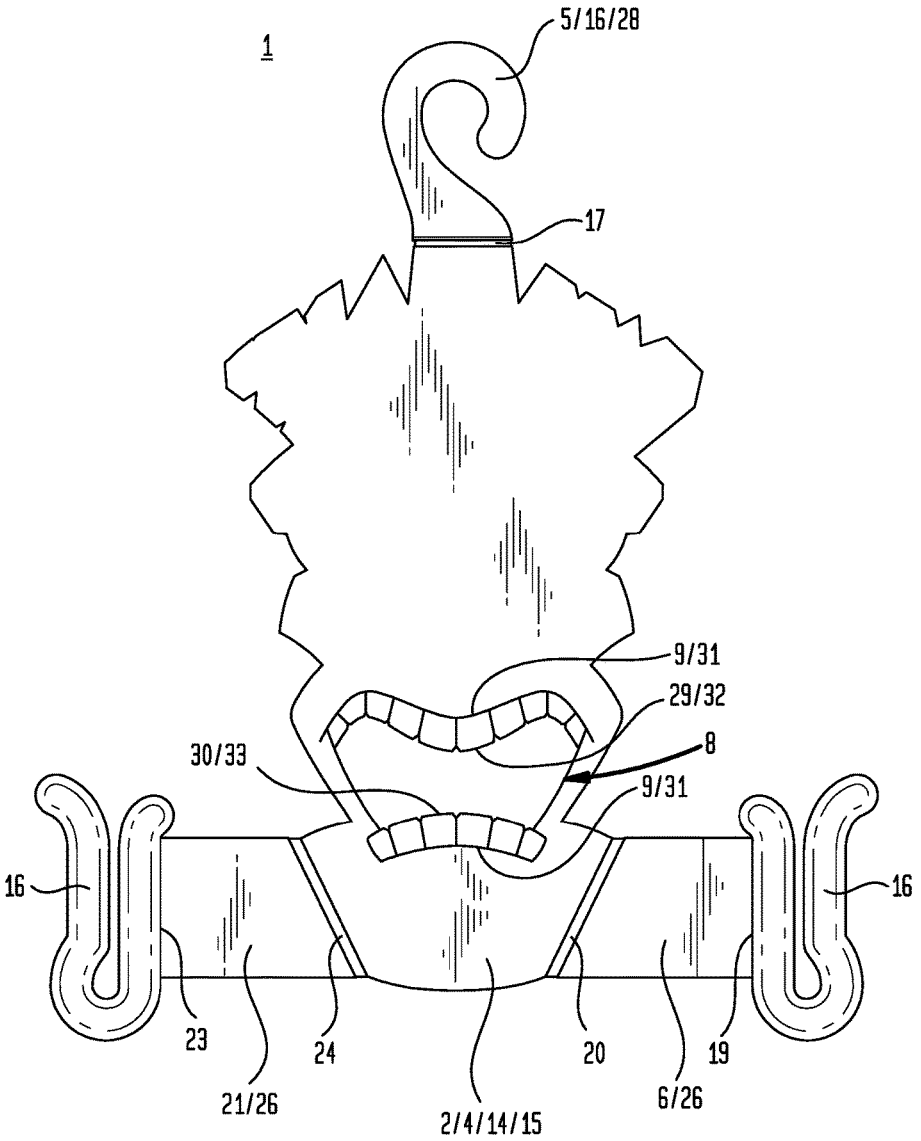

FIG. 16 is a back view of a particular embodiment of the hanger system, whereby a body of the hanger element is configured as the head of Tiki.

Figure 17:
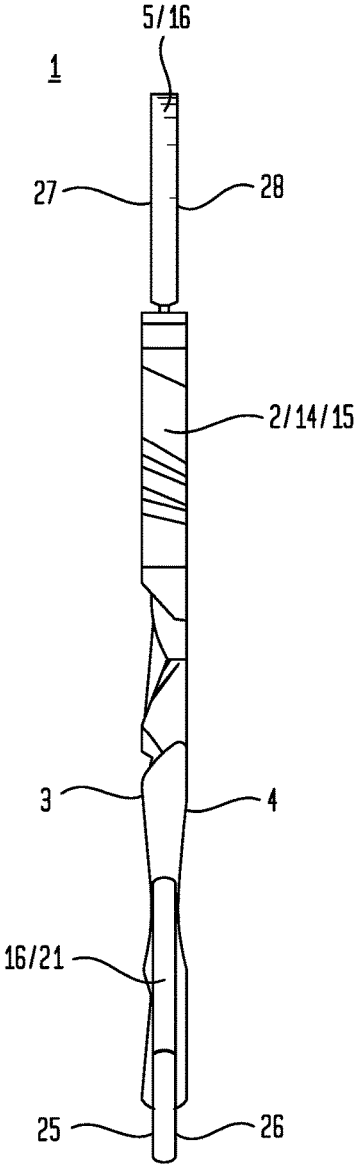

FIG. 17 is a first side view of a particular embodiment of the hanger system, whereby a body of the hanger element is configured as the head of Tiki.

Figure 18:
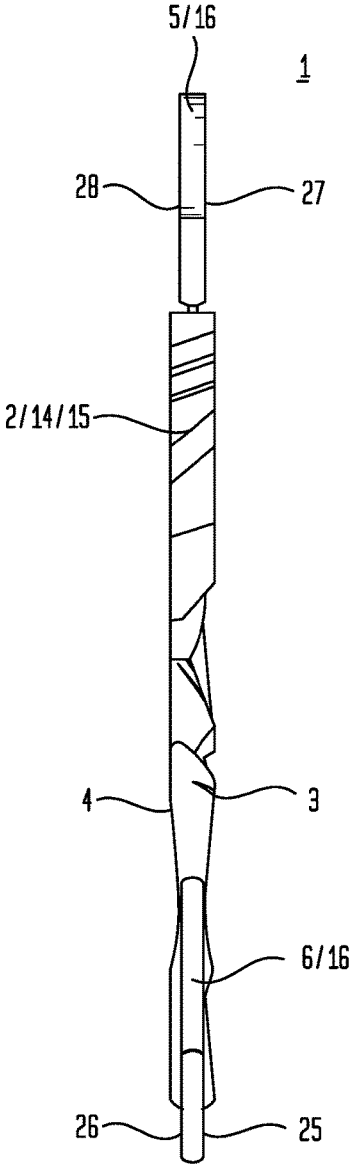

FIG. 18 is a second side view of a particular embodiment of the hanger system, whereby a body of the hanger element is configured as the head of Tiki.

Figure 19:
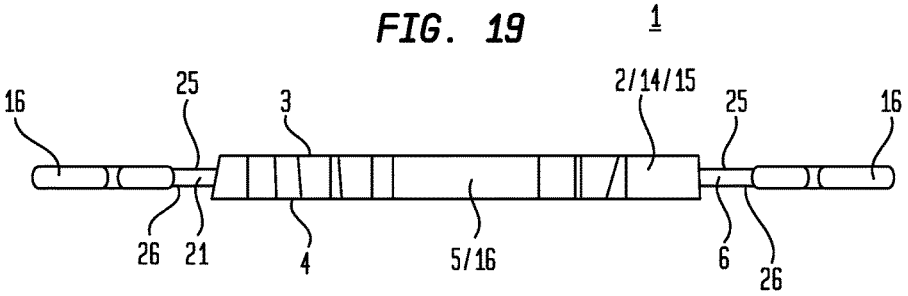

FIG. 19 is a top end view of a particular embodiment of the hanger system, whereby a body of the hanger element is configured as the head of Tiki.

Figure 20:
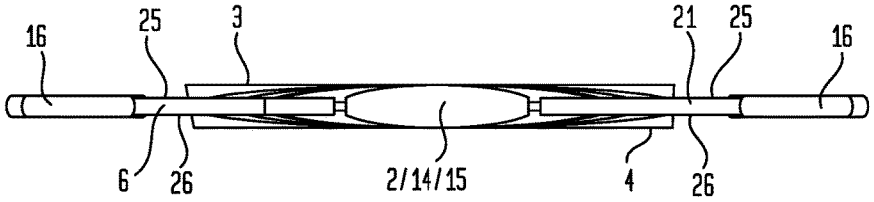

FIG. 20 is a bottom end view of a particular embodiment of the hanger system, whereby a body of the hanger element is configured as the head of Tiki.

Figure 21:
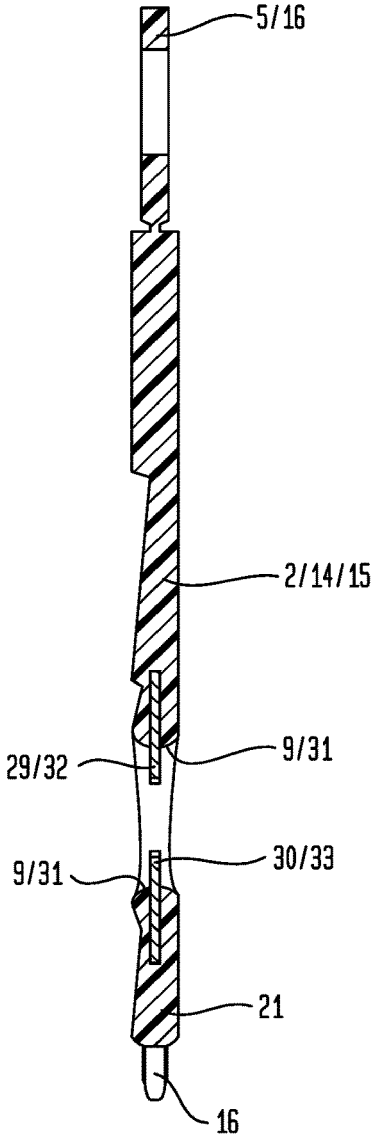

FIG. 21 is a cross-sectional view 21-21 of the particular embodiment of the hanger system shown in FIG. 15.

Figure 22:
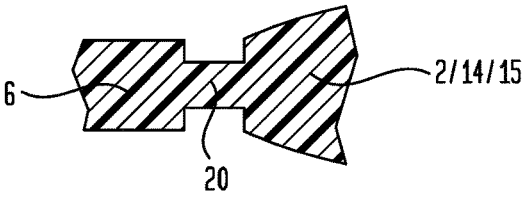

FIG. 22 is a cross-sectional view 22-22 of a first support element junction of the particular embodiment of the hanger system shown in FIG. 15.

DETAILED DESCRIPTION OF THE PREFERRED EMBODIMENTS

Now referring primarily to FIG. 1A, FIG. 1B, FIG. 11A, and FIG. 11B, which illustrate two methods of using a particular embodiment of a hanger system (1) including a body (2) having opposing body first and second faces (3)(4); a hanger element (5) coupled to the body (2), the hanger element (5) configured to facilitate hanging of the hanger system (1); a first support element (6) coupled to the body (2), the first support element (6) configured to support a first article (7); and an aperture element (8) disposed within the body (2), the aperture element (8) having an aperture element edge (9) defining an aperture element opening (10) which communicates between the body first and second faces (3)(4); whereby the aperture element opening (10) is configured to receive at least a portion of a bottle cap (11) removably coupled to a bottle (12); and whereby the aperture element edge (9) is configured to engage the bottle cap (11) to facilitate removal of the bottle cap (11) from the bottle (12).

Further, for the purposes of the present invention, the term "coupled to" means linked, joined, or connected to, whether indirectly or directly. Thus, as to particular embodiments, coupled can mean indirectly linked, indirectly joined, or indirectly connected to; and, as to other particular embodiments, coupled can mean directly linked, directly joined, or directly connected to.

Figure 1A:
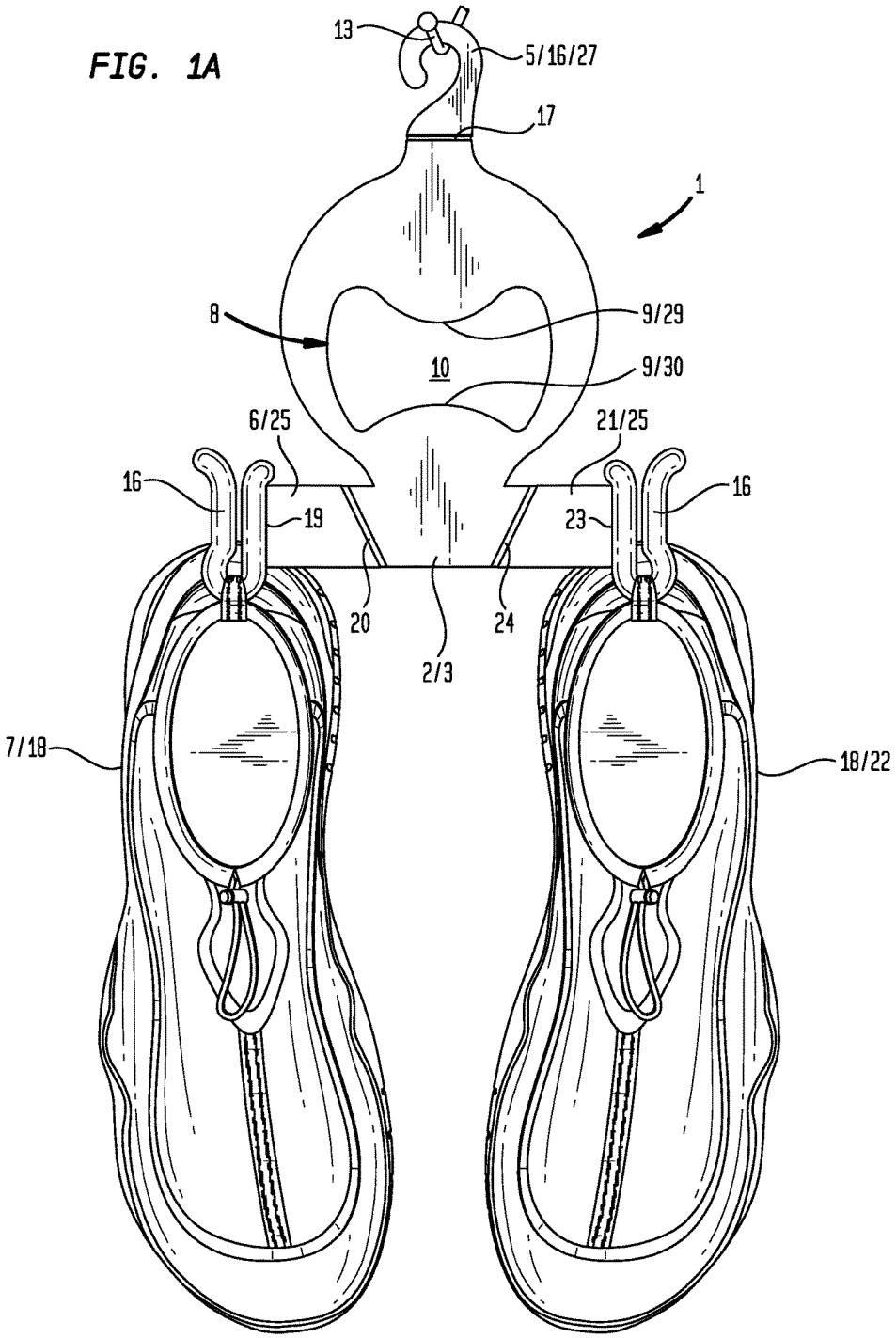
FIG. 1A is an illustration of a method of using a particular embodiment of the hanger system to couple first and second articles to a support member.
Figure 11A:
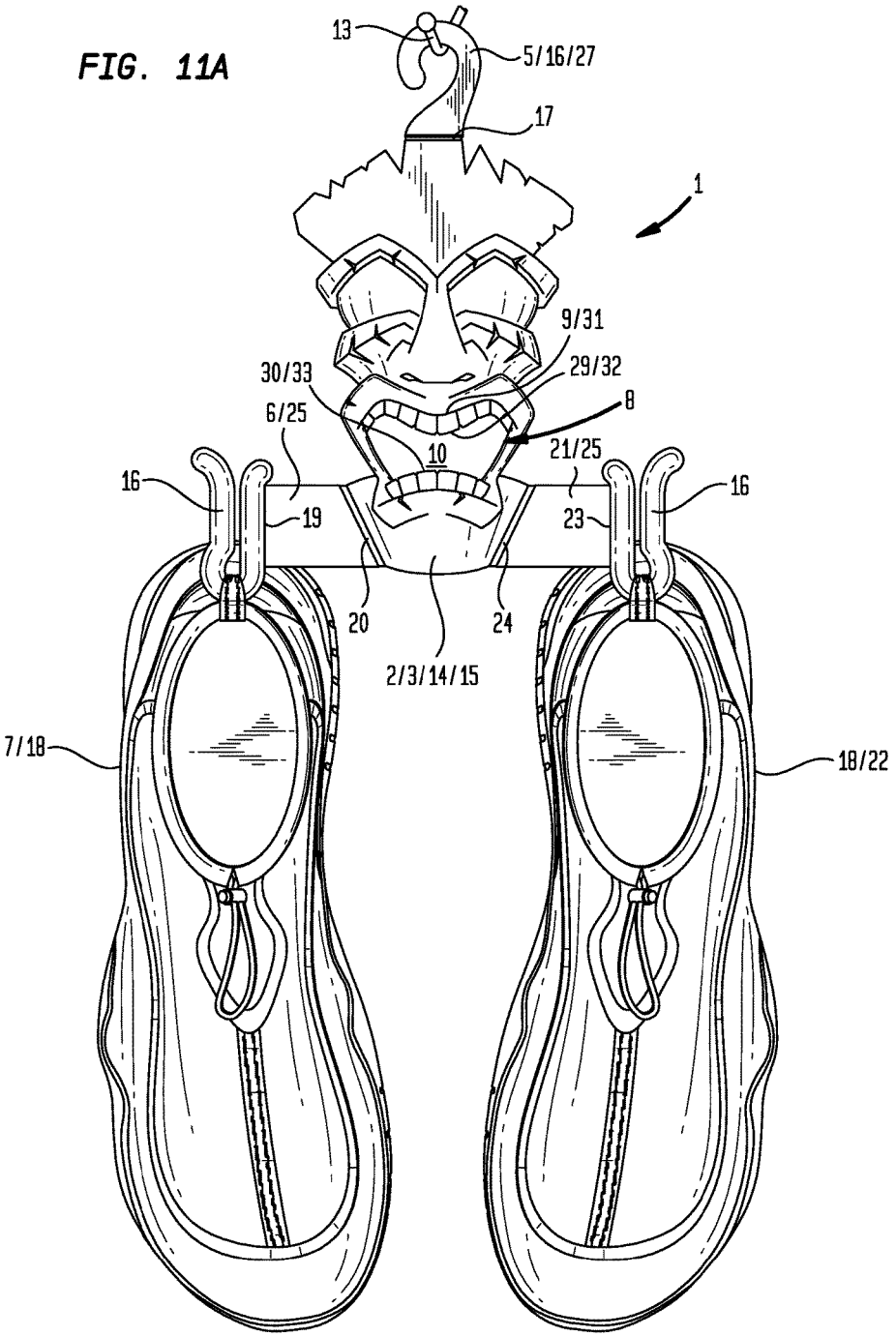
FIG. 11A is an illustration of a method of using a particular embodiment of the hanger system to couple first and second articles to a support member, whereby a body of the hanger element is configured as the head of Tiki.

Now referring primarily to FIG. 1A and FIG. 11A, the first method of using the particular embodiment of the hanger system (1) described above can include removably coupling the hanger element (5) to a support member (13) to hang the hanger system (1) on the support member (13); and removably coupling the first article (7) to the first support element (6). Accordingly, the hanger system (1) can be used to couple the first article (7) to the support member (13), for example to display the first article (7) on the support member (13).

Figure 1B:
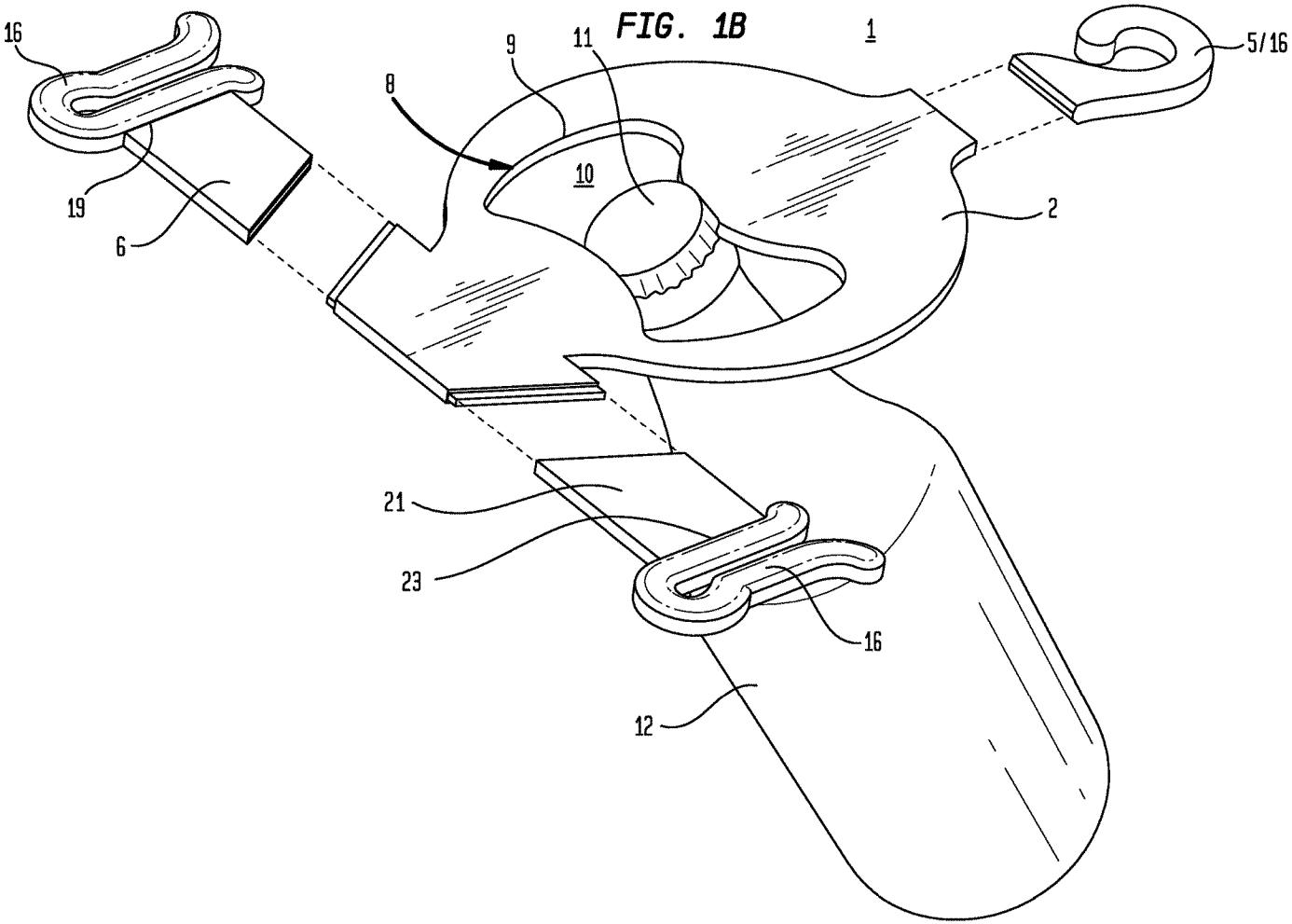
FIG. 1B is an illustration of a method of using a particular embodiment of the hanger system to remove a bottle cap from a bottle.
Figure 2:
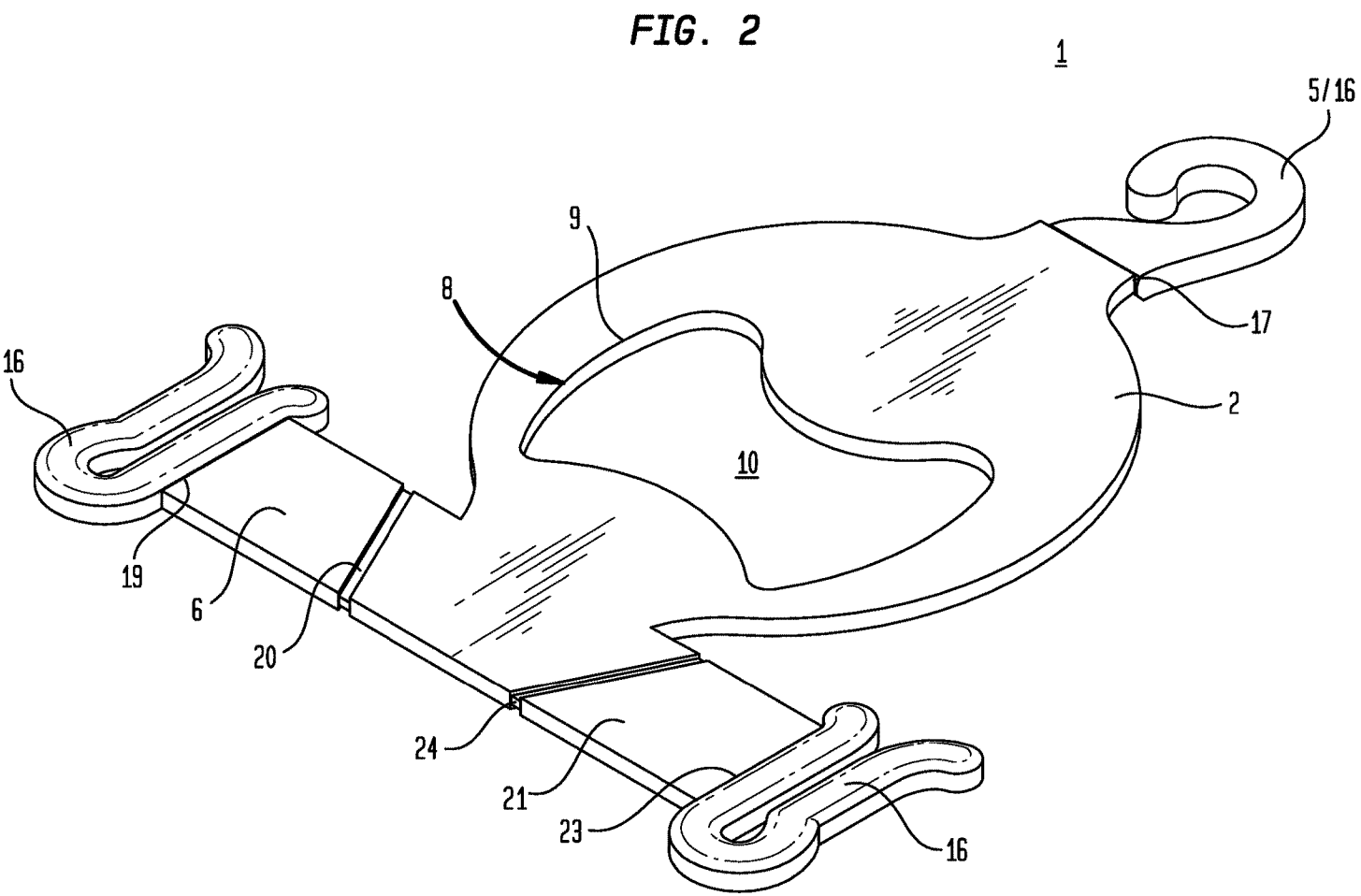
FIG. 2 is a perspective view of a particular embodiment of the hanger system.
Figure 3:
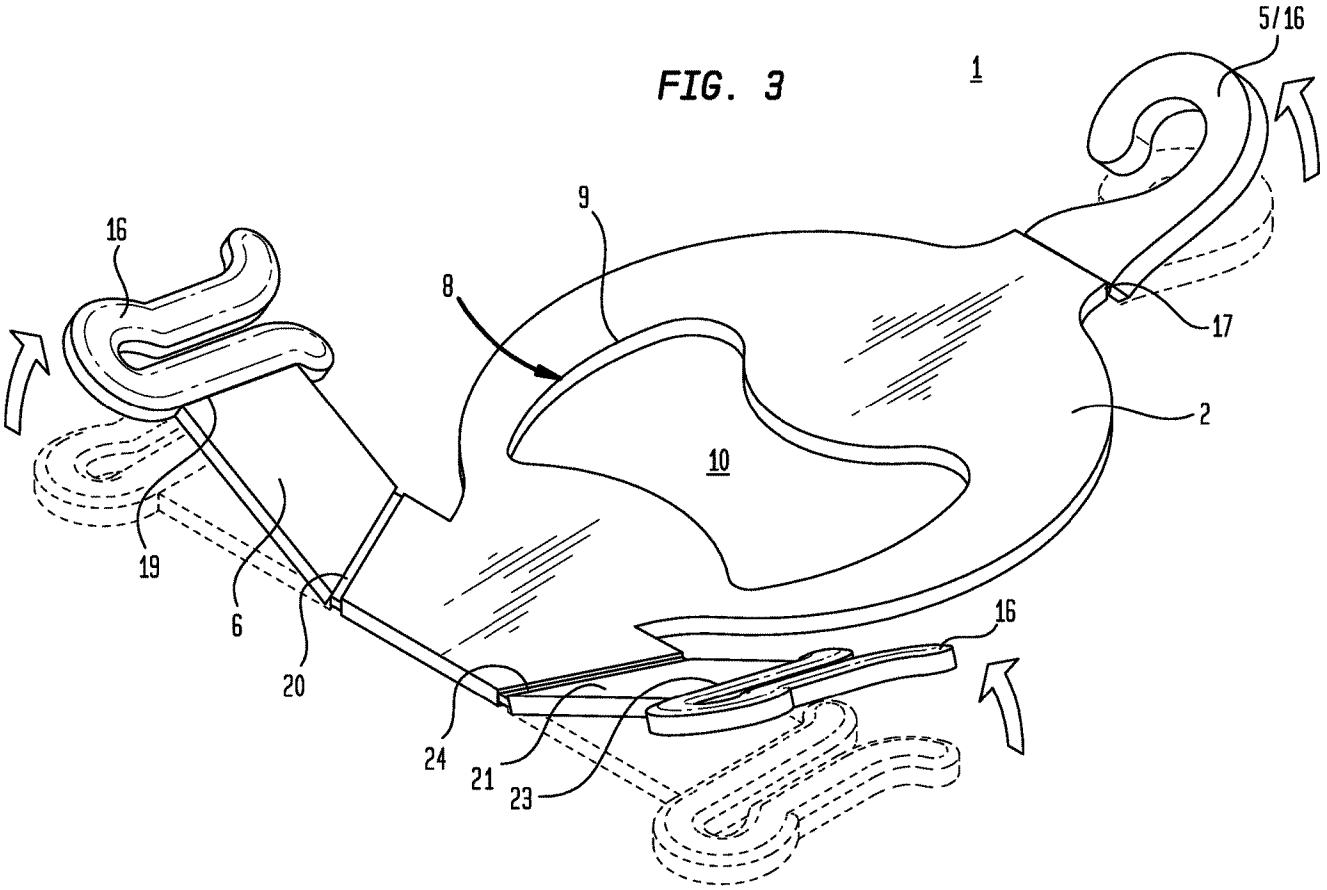
FIG. 3 is a perspective view of a particular embodiment of the hanger system, whereby a hanger element, a first support element, and a second support element are each removably coupled to a body of the hanger system and can be rotated about a corresponding hanger element junction, first support element junction, and second support element junction.
Figure 4:
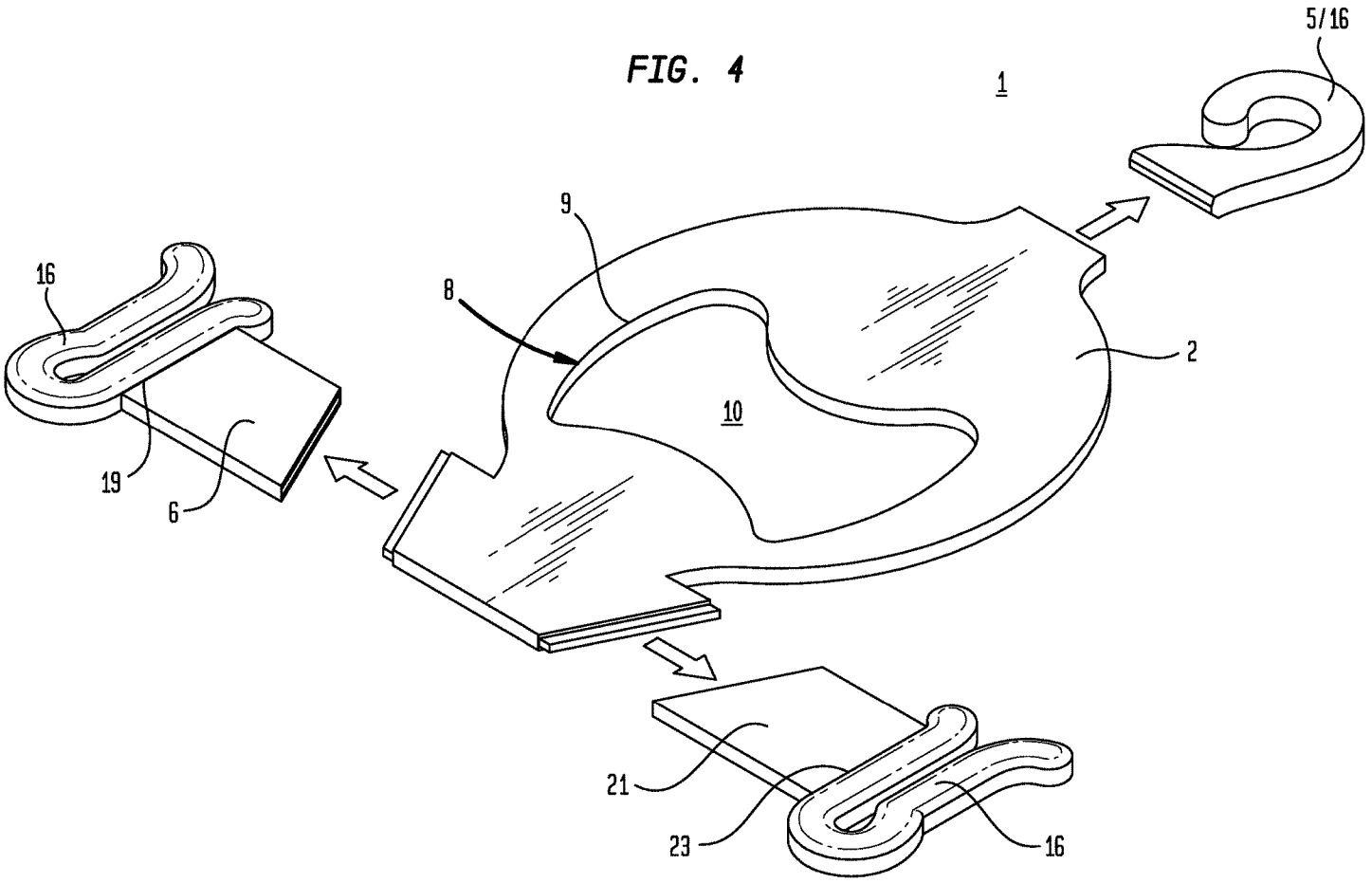
FIG. 4 is a perspective view of the particular embodiment of the hanger system shown in FIG. 3, whereby following rotation about the corresponding hanger element junction, first support element junction, and second support element junction, the hanger element, the first support element, and the second support element are uncoupled from the body.
Figure 5:
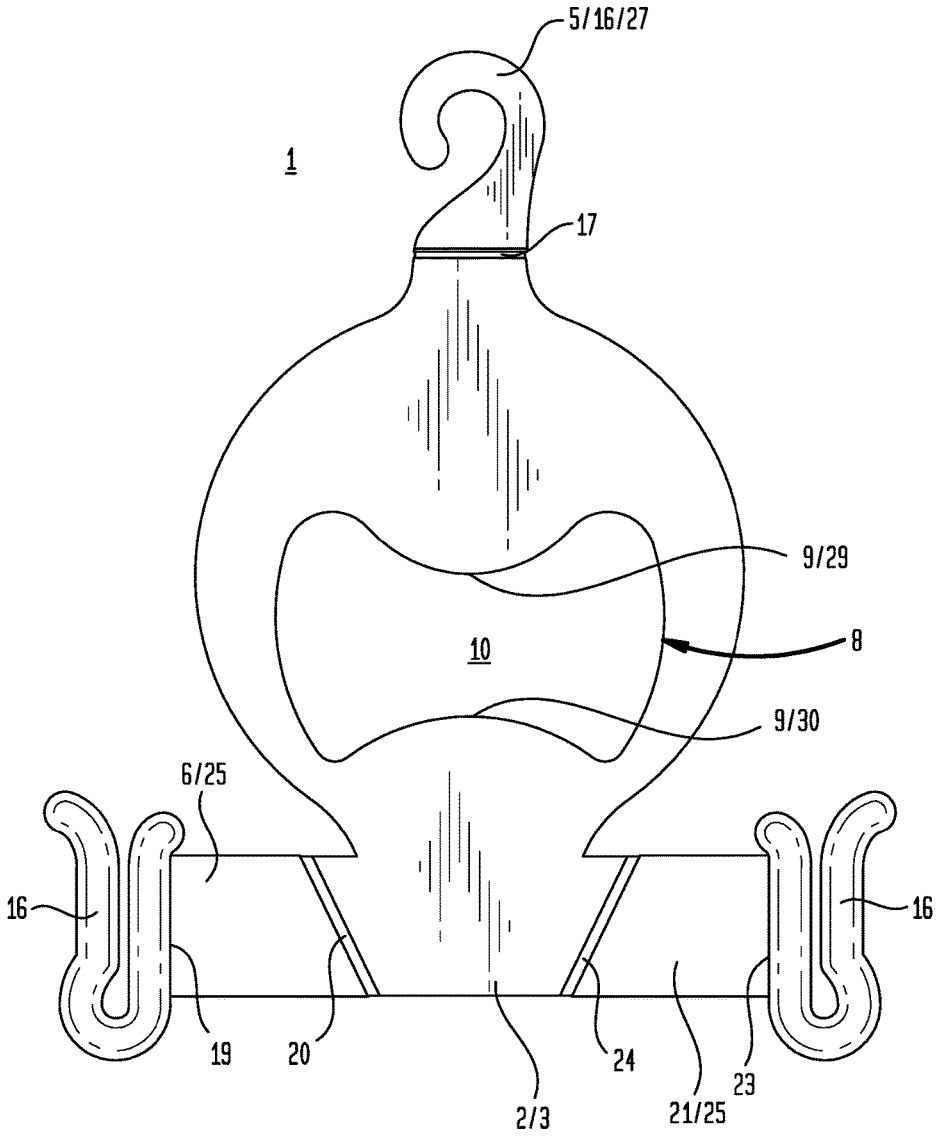
FIG. 5 is a front view of a particular embodiment of the hanger system.
Figure 6:
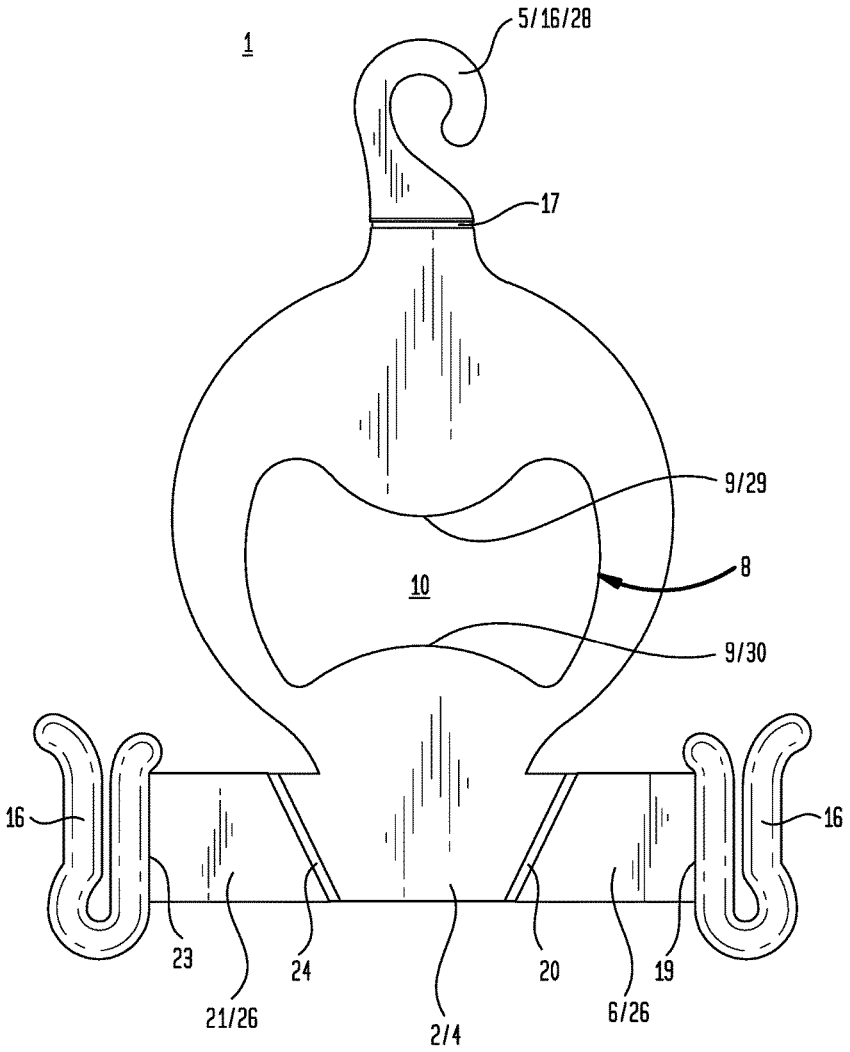
FIG. 6 is a back view of a particular embodiment of the hanger system.
Figure 7:
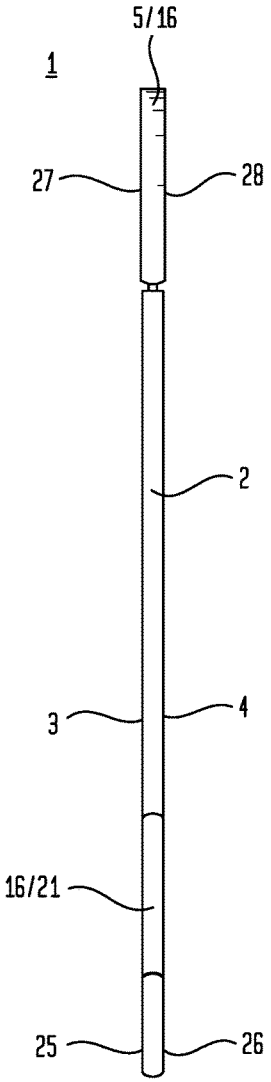
FIG. 7 is a first side view of a particular embodiment of the hanger system.
Figure 8:
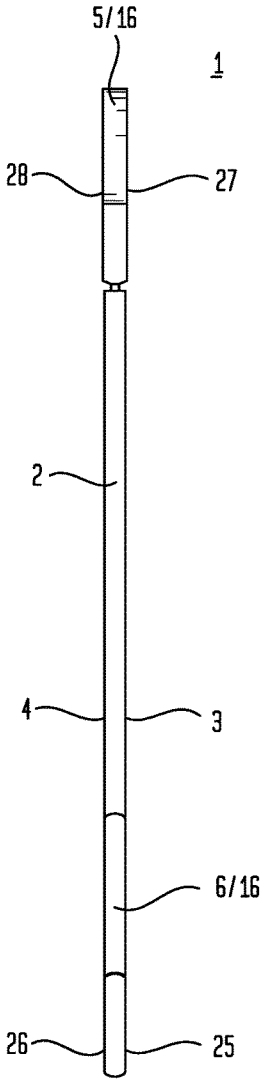
FIG. 8 is a second side view of a particular embodiment of the hanger system.
Figure 9:
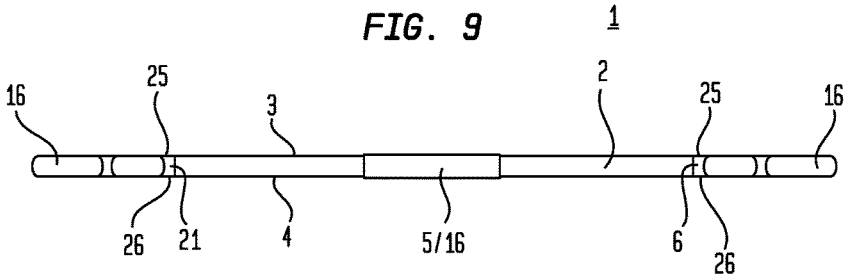
FIG. 9 is a top end view of a particular embodiment of the hanger system.
Figure 10:
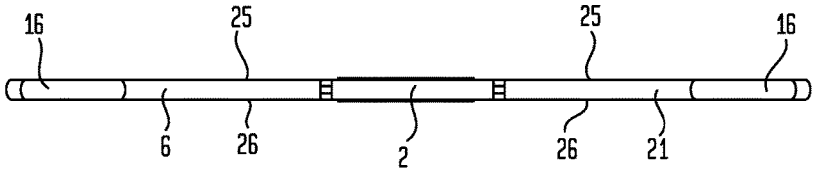
FIG. 10 is a bottom end view of a particular embodiment of the hanger system.
Figure 11B:
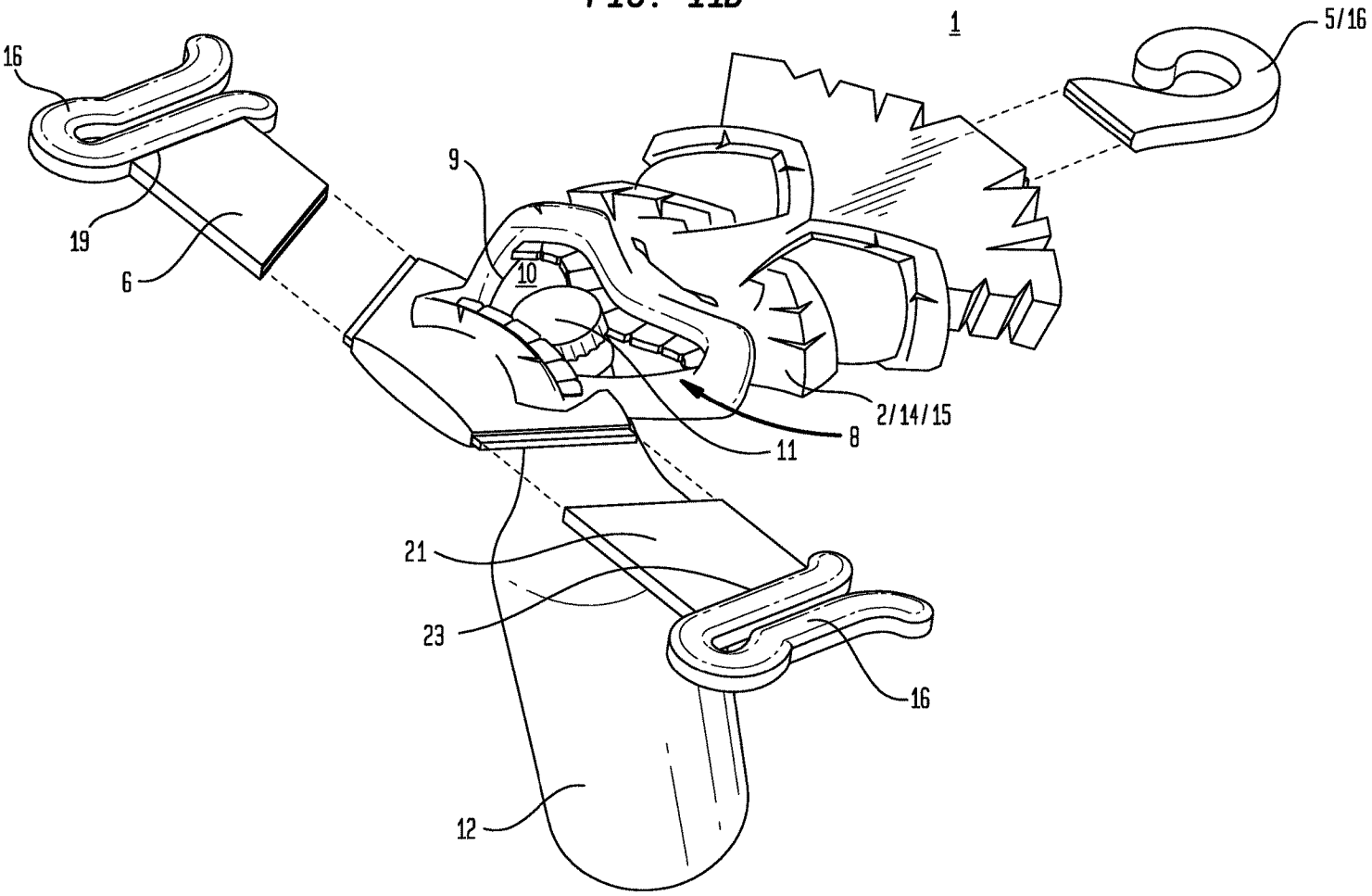
FIG. 11B is an illustration of a method of using a particular embodiment of the hanger system to remove a bottle cap from a bottle, whereby a body of the hanger element is configured as the head of Tiki.
Figure 12:
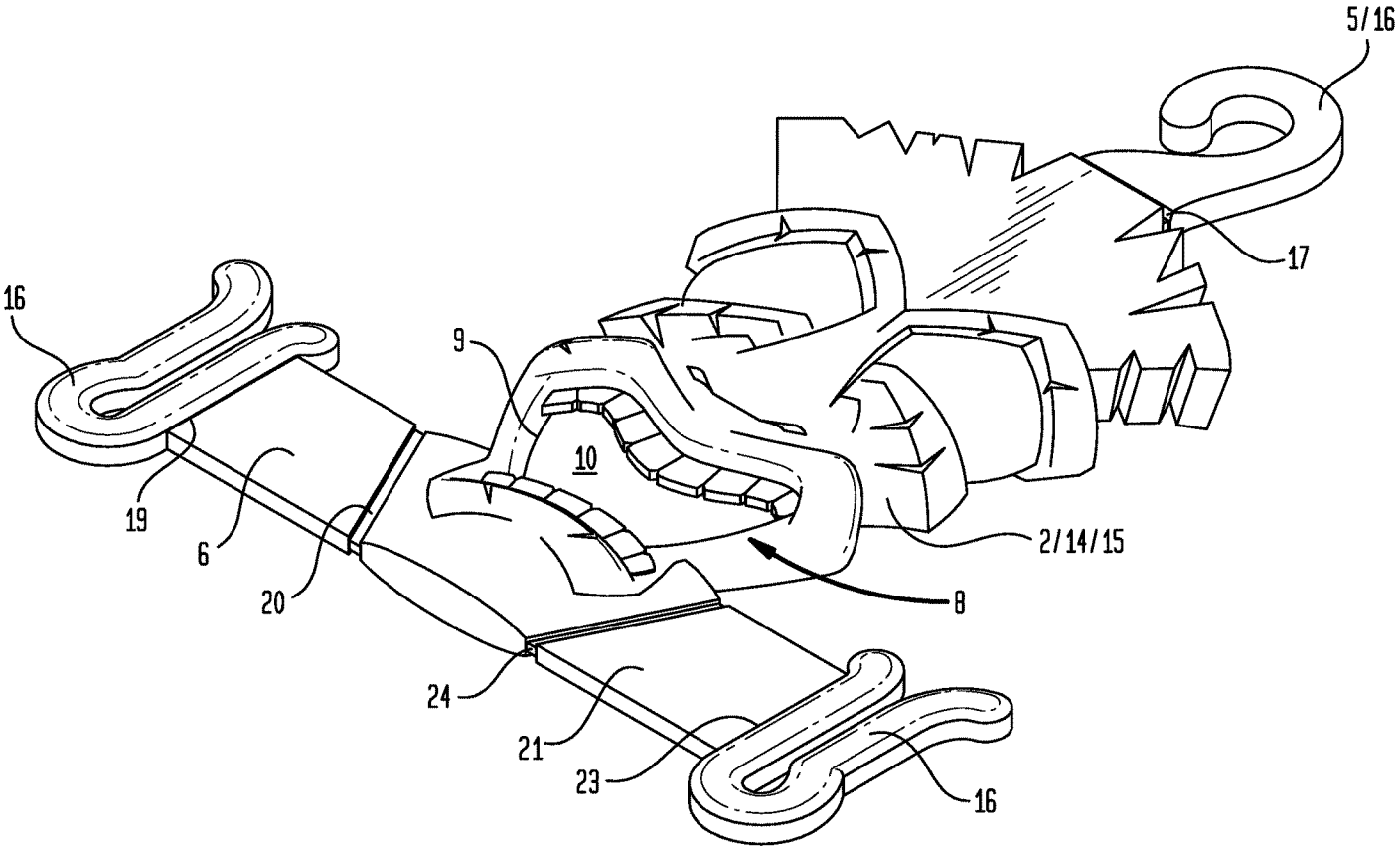
FIG. 12 is a perspective view of a particular embodiment of the hanger system, whereby a body of the hanger element is configured as the head of Tiki.

Now referring primarily to FIG. 1B and FIG. 11B, the second method of using the particular embodiment of the hanger system (1) described above can include receiving at least a portion of the bottle cap (11) removably coupled to the bottle (12) within the aperture element opening (10); and engaging the aperture element edge (9) with the bottle cap (11) to remove the bottle cap (11) from the bottle (12).

Now referring primarily to FIG. 2 through FIG. 10, and FIG. 12 through FIG. 21, the hanger system (1) includes a body (2) having opposing body first and second faces (3)(4). The body (2) can have any of a numerous and wide variety of configurations. As to particular embodiments, the body (2) can by defined by one or more geometric shapes, such as a circle, an oval, a triangle, a square, a rectangle, a trapezoid, a polygon, or the like, or combinations thereof (as shown in the examples of FIG. 2 through FIG. 10). As to other particular embodiments, the body (2) can be defined by one or more freeform shapes to provide any of a numerous and wide variety of body configurations. As an illustrative example, the body (2) can be fanciful body configuration (14), for example a humanoid body configuration such as the head of Tiki (15), the first man according to Maori mythology (as shown in the examples of FIG. 12 through FIG. 21).

Again referring primarily to FIG. 2 through FIG. 10, and FIG. 12 through FIG. 21, the hanger system (1) further includes a hanger element (5) coupled to the body (2). The hanger element (5) can have any of a numerous and wide variety of configurations which facilitate hanging of the hanger system (1).

As to particular embodiments, the hanger element (5) can outwardly extend from the body (2). As an illustrative example, the hanger element (5) can be configured as an annular member or a hook (16) (as shown in the examples of the Figures) which outwardly extends from the body (2).

Now referring primarily to FIG. 3, FIG. 4, FIG. 13, and FIG. 14, as to particular embodiments of the hanger system (1) having the hanger element (5) outwardly extending from the body (2), the hanger element (5) can be removably coupled to the body (2). As an illustrative example, the hanger element (5) can be removably coupled to the body (2) along a hanger element junction (17) which defines a rotation axis about which the hanger element (5) can rotate upon forcible urging, whereby a sufficient amount of forcible urging can uncouple the hanger element (5) from the body (2) along the hanger element junction (17).

As to particular embodiments, the hanger element junction (17) can be configured to have a lesser thickness relative to portions of the body (2) and hanger element (5) adjacent to the hanger element junction (17), the lesser thickness facilitating the rotation of the hanger element (5) about the hanger element junction (17) and the consequent uncoupling of the hanger element (5) from the body (2) along the hanger element junction (17) upon forcible urging.

Now referring primarily to FIG. 2 through FIG. 10, and FIG. 12 through FIG. 21, the hanger system (5) further includes a first support element (6) coupled to the body (2). The first support element (6) can have any of a numerous and wide variety of configurations capable of supporting a first article (7).

As to particular embodiments, the first article (7) can include a wearable article, such as an article of footwear, clothing, jewelry, or the like. As shown in the illustrative example of FIG. 1A and FIG. 11A, the first article (7) can include a shoe (18).

As to particular embodiments, the first support element (6) can outwardly extend from the body (2). As an illustrative example, the first support element (6) can be configured as an elongate first support element (6) outwardly extending from the body (2), the elongate first support element (6) having a clip or hook (16) (as shown in the examples of the Figures) disposed proximate an elongate first support element end (19) distal from the body (2).

Now referring primarily to FIG. 3, FIG. 4, FIG. 13, and FIG. 14, as to particular embodiments of the hanger system (1) having the first support element (6) outwardly extending from the body (2), the first support element (6) can be removably coupled to the body (2). As an illustrative example, the first support element (6) can be removably coupled to the body (2) along a first support element junction (20) which defines a rotation axis about which the first support element (6) can rotate upon forcible urging, whereby a sufficient amount of forcible urging can uncouple the first support element (6) from the body (2) along the first support element junction (20).

Now referring primarily to FIG. 22, as to particular embodiments, the first support element junction (20) can be configured to have a lesser thickness relative to portions of the body (2) and first support element (6) adjacent to the first support element junction (20), the lesser thickness facilitating the rotation of the first support element (6) about the first support element junction (20) and the consequent uncoupling of the first support element (6) from the body (2) along the first support element junction (20) upon forcible urging.

Now referring primarily to FIG. 2 through FIG. 10, and FIG. 12 through FIG. 21, the hanger system (1) can further include a second support element (21) coupled to the body (2). The second support element (21) can have any of a numerous and wide variety of configurations capable of supporting a second article (22), which can be similar to the first article (7) as described above.

As to particular embodiments, the second support element (21) can outwardly extend from the body (2). As an illustrative example, the second support element (21) can be configured as an elongate second support element (21) outwardly extending from the body (2), the elongate second support element (21) having a clip or hook (16) (as shown in the examples of the Figures) disposed proximate an elongate second support element end (23) distal from the body (2). As to particular embodiments, the second support element (21) can outwardly extend from the body (2) opposite the first support element (6).

Now referring primarily to FIG. 3, FIG. 4, FIG. 13, and FIG. 14, as to particular embodiments of the hanger system (1) having the second support element (21) outwardly extending from the body (2), the second support element (21) can be removably coupled to the body (2). As an illustrative example, the second support element (21) can be removably coupled to the body (2) along a second support element junction (24) which defines a rotation axis about which the second support element (21) can rotate upon forcible urging, whereby a sufficient amount of forcible urging can uncouple the second support element (21) from the body (2) along the second support element junction (24).

As to particular embodiments, the second support element junction (24) can be configured to have a lesser thickness relative to portions of the body (2) and second support element (21) adjacent to the second support element junction (24), the lesser thickness facilitating the rotation of the second support element (21) about the second support element junction (24) and the consequent uncoupling of the second support element (21) from the body (2) along the second support element junction (24) upon forcible urging.

As to particular embodiments of the hanger system (1) having first and second support elements (6)(21), each of the first and second support elements (6)(21) can have opposing support element first and second faces (25)(26), whereby each support element first face (25) disposes in generally coplanar relation with the body first face (3) and each support element second face (26) disposes in generally coplanar relation with the body second face (4).

As to particular embodiments of the hanger system (1) having first and second support elements (6)(21), each of the first and second support elements (6)(21) can have opposing support element first and second faces (25)(26) whereby each support element first face (25) disposes in generally coplanar relation with the body first face (3) and with a hanger element first face (27) of the hanger element (5), and each support element second face (26) disposes in generally coplanar relation with the body second face (4) and a hanger element second face (28) of the hanger element (5).

As to particular embodiments, the hanger system (1) can further include additional support elements, which can be similar to the first and second support elements (6)(21) as described above, capable of supporting additional articles, which can be similar to the first and second articles (7)(22) as described above, depending upon the application.

Now referring primarily to FIG. 2 through FIG. 10, and FIG. 12 through FIG. 21, the hanger system (1) further includes an aperture element (8) disposed within the body (2), whereby the aperture element (8) has an aperture element edge (9) defining an aperture element opening (10) which communicates between the body first and second faces (3)(4). The aperture element opening (10) is configured to receive at least a portion of a bottle cap (11) removably coupled to a bottle (12). The aperture element edge (9) is configured to engage the bottle cap (11) to facilitate removal of the bottle cap (11) from the bottle (12).

Typically, but not necessarily, the bottle cap (11) can be formed from a rigid material, such as metal, and can overlay a bottle opening disposed in the top of the bottle (12), through which contents of the bottle (12) can egress from the bottle (12). As to particular embodiments, the bottle cap (11) can be affixed about a bottle rim which defines the bottle opening by crimping.

Again referring primarily to FIG. 2 through FIG. 10, and FIG. 12 through FIG. 21, as to particular embodiments, the aperture element edge (9) can include a flange (29) which inwardly extends into the aperture element opening (10) and a fulcrum (30) disposed opposite the flange (29), whereby the flange (29) and the fulcrum (30) can be configured to engage the bottle cap (11) to facilitate removal of the bottle cap (11) from the bottle (12) to which the bottle cap (11) is removably coupled, as is well understood in the art.

As an illustrative example, at least a portion of the bottle cap (11) can be received within the aperture element opening (10), whereby the flange (29) can operably engage an underside of the bottle cap (11). The fulcrum (30) can operably engage a top portion of the bottle cap (11) to provide a pivot point on the bottle cap (11) relative to the bottle (12) when a user uses the body (2) of the hanger system (1) as a lever, thereby allowing the flange (29) to pry the bottle cap (11) off of the bottle rim to uncouple the bottle cap (11) from the bottle (12).

Now referring primarily to FIG. 15 and FIG. 16, as to particular embodiments of the hanger system (1) having the body (2) configured as an image of the head of Tiki (15), the aperture element edge (9) can define a mouth (31) of Tiki (15). As to particular embodiments, the flange (29) can define a portion of upper teeth (32) within the mouth (31) of Tiki (15) and the fulcrum (30) can define a portion of lower teeth (33) within the mouth (31) of Tiki (15).

A method of making a hanger system (1) can include providing a body (2) having opposing body first and second faces (3)(4); coupling a hanger element (5) to the body (2), the hanger element (5) configured to facilitate hanging of the hanger system (1); coupling a first support element (6) to the body (2), the first support element (6) configured to support a first article (7); and disposing an aperture element (8) within the body (2), the aperture element (8) having an aperture element edge (9) defining an aperture element opening (10) which communicates between the body first and second faces (3)(4); whereby the aperture element opening (10) is configured to receive at least a portion of a bottle cap (11) removably coupled to a bottle (12); and whereby the aperture element edge (9) is configured to engage the bottle cap (11) to facilitate removal of the bottle cap (11) from the bottle (12).

The method of making the hanger system (1) can, but need not necessarily, further include configuring the hanger element (5) as a hook (16) which outwardly extends from the body (2).

The method of making the hanger system (1) can, but need not necessarily, further include removably coupling the hanger element (5) to the body (2).

The method of making the hanger system (1) can, but need not necessarily, further include configuring the first support element (6) as a hook (16) which outwardly extends from the body (2).

The method of making the hanger system (1) can, but need not necessarily, further include removably coupling the first support element (6) to the body (2).

The method of making the hanger system (1) can, but need not necessarily, further include coupling a second support element (21) to the body (2), the second support element (21) configured to support a second article (22).

The method of making the hanger system (1) can, but need not necessarily, further include configuring the second support element (21) as a hook (16) which outwardly extends from the body (2).

The method of making the hanger system (1) can, but need not necessarily, further include outwardly extending the second support element (21) from the body (2) opposite the first support element (6).

The method of making the hanger system (1) can, but need not necessarily, further include removably coupling the second support element (21) to the body (2).

The method of making the hanger system (1) can, but need not necessarily, further include configuring the aperture element edge (9) to have a flange (29) which inwardly extends into the aperture element opening (10); and a fulcrum (30) disposed opposite the flange (29); whereby the flange (29) and the fulcrum (30) are configured to engage the bottle cap (11) to facilitate removal of the bottle cap (11) from the bottle (12).

The method of making the hanger system (1) can, but need not necessarily, further include configuring the body (2) as an image of a head of Tiki (15).

The method of making the hanger system (1) can, but need not necessarily, further include configuring the aperture element edge (9) to define a mouth (31) of Tiki (15).

The method of making the hanger system (1) can, but need not necessarily, further include configuring the aperture element edge (9) to have a flange (29) which inwardly extends into the aperture element opening (10); and configuring the flange (29) to define a portion of upper teeth (32) within the mouth (31) of Tiki (15); whereby the flange (29) is configured to engage the bottle cap (11) to facilitate removal of the bottle cap (11) from the bottle (12).

The method of making the hanger system (1) can, but need not necessarily, further include configuring the aperture element edge (9) to have a fulcrum (30) disposed opposite the flange (29); and configuring the fulcrum (30) to define a portion of lower teeth (33) within the mouth (31) of Tiki (15); whereby the flange (29) and the fulcrum (30) are configured to engage the bottle cap (11) to facilitate removal of the bottle cap (11) from the bottle (12).

Elements of the hanger system (1) can be entirely formed of the same material, or alternatively, various elements of the hanger system (1) can be formed from different materials. As to particular embodiments, a portion of the body (2) which defines the aperture element edge (9) can be formed from a rigid material which allows the aperture element edge (9) to engage the bottle cap (11) to facilitate removal of the bottle cap (11) from the bottle (12). As to particular embodiments, the flange (29) and the fulcrum (30) can be formed from the rigid material, allowing the flange (29) and fulcrum (30) to engage the bottle cap (11) to facilitate removal of the bottle cap (11) from the bottle (12). As non-limiting examples, the rigid material can include metal, wood, plastic, plastic-like material, acrylic, polyamide, polyester, microfiber, polypropylene, polyvinyl chloride-based materials, silicone-based materials, or the like, or combinations thereof.

The hanger system (1) or elements of the hanger system (1) can be produced from any of a wide variety of processes depending upon the application, such as molding, press molding, injection molding, fabrication, machining, printing, additive printing, or the like, or combinations thereof, as one piece or assembled from a plurality of pieces into an embodiment of the hanger system (1).

Now referring primarily to FIG. 1A and FIG. 11A, a method of using a particular embodiment of the hanger system (1) can include removably coupling the hanger element (5) to a support member (13) to hang the hanger system (1) on the support member (13); and removably coupling the first article (7) to the first support element (6). Accordingly, the hanger system (1) can be used to couple the first article (7) to the support member (13), for example to display the first article (7) on the support member (13).

Now referring primarily to FIG. 1B and FIG. 11B, a method of using a particular embodiment of the hanger system (1) can include receiving at least a portion of the bottle cap (11) removably coupled to the bottle (12) within the aperture element opening (10); and engaging the aperture element edge (9) with the bottle cap (11) to remove the bottle cap (11) from the bottle (12).

Now referring primarily to FIG. 3, FIG. 4, FIG. 13, and FIG. 14, as to particular embodiments of the hanger system (1) having a hanger element (5) which is removably coupled to the body (2), the method can further include uncoupling the hanger element (5) from the body (2) prior to receiving at least a portion of the bottle cap (11) removably coupled to the bottle (12) within the aperture element opening (10) and engaging the aperture element edge (9) with the bottle cap (11) to remove the bottle cap (11) from the bottle (12).

Again referring primarily to FIG. 3, FIG. 4, FIG. 13, and FIG. 14, as to particular embodiments of the hanger system (1) a first support element (6) (and, as to particular embodiments, a second support element (21)), each of which is removably coupled to the body (2), the method can further include uncoupling the first support element (6) (and, as to particular embodiments, the second support element (21)) from the body (2) prior to receiving at least a portion of the bottle cap (11) removably coupled to the bottle (12) within the aperture element opening (10) and engaging the aperture element edge (9) with the bottle cap (11) to remove the bottle cap (11) from the bottle (12).

As can be easily understood from the foregoing, the basic concepts of the present invention may be embodied in a variety of ways. The invention involves numerous and varied embodiments of a hanger system with an integrated bottle opener and methods for making and using such a hanger system, including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "hanger" should be understood to encompass disclosure of the act of "hanging"—whether explicitly discussed or not—and, conversely, were there effectively disclosure of the act of "hanging", such a disclosure should be understood to encompass disclosure of a "hanger" and even a "means for hanging". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the hanger systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A hanger system comprising:

a body having opposing body first and second faces;

a hanger element removably coupled to said body along a hanger element junction which facilitates irreversible detachment of said hanger element from said body;

wherein said hanger element comprises a hook which outwardly extends from said body;

a first support element removably coupled to said body along a first support element junction which facilitates irreversible detachment of said first support element from said body; and an aperture element disposed within said body, said aperture element having an aperture element edge defining an aperture element opening which communicates between said body first and second faces;

wherein said aperture element opening is configured to receive at least a portion of a bottle cap removably coupled to a bottle; and wherein said aperture element edge is configured to engage said bottle cap to facilitate removal of said bottle cap from said bottle.

2. The hanger system of claim 1, wherein said first support element comprises a hook which outwardly extends from said body.

3. The hanger system of claim 1, further comprising a second support element coupled to said body, said second support element configured to support a second article.

4. The hanger system of claim 3, wherein said second support element comprises a hook which outwardly extends from said body.

5. The hanger system of claim 3, wherein said second support element outwardly extends from said body opposite said first support element.

6. The hanger system of claim 3, wherein said second support element is removably coupled to said body along a second support element junction which facilitates irreversible detachment of said second support element from said body.

7. The hanger system of claim 6, wherein said second support element junction defines a rotation axis about which said second support element can rotate to irreversibly detach said second support element from said body along said second support element junction.

8. The hanger system of claim 6, wherein said second support element junction comprises a lesser thickness relative to portions of said body and said second support element adjacent to said second support element junction.

9. The hanger system of claim 1, wherein said aperture element edge comprises:

a flange which inwardly extends into said aperture element opening; and a fulcrum disposed opposite said flange;

wherein said flange and said fulcrum are configured to engage said bottle cap to facilitate removal of said bottle cap from said bottle.

10. The hanger system of claim 1, wherein said hanger element junction defines a rotation axis about which said hanger element can rotate to irreversibly detach said hanger element from said body along said hanger element junction.

11. The hanger system of claim 1, wherein said hanger element junction comprises a lesser thickness relative to portions of said body and said hanger element adjacent to said hanger element junction.

12. The hanger system of claim 1, wherein said first support element junction defines a rotation axis about which said first support element can rotate to irreversibly detach said first support element from said body along said first support element junction.

13. The hanger system of claim 1, wherein said first support element junction comprises a lesser thickness relative to portions of said body and said first support element adjacent to said first support element junction.

14. A hanger system comprising:

a body having opposing body first and second faces;

wherein said body is configured as an image of a head of Tiki;

a hanger element removably coupled to said body along a hanger element junction which facilitates irreversible detachment of said hanger element from said body;

a first support element coupled to said body, said first support element configured to support a first article; and an aperture element disposed within said body, said aperture element having an aperture element edge defining an aperture element opening which communicates between said body first and second faces;

wherein said aperture element opening is configured to receive at least a portion of a bottle cap removably coupled to a bottle; and wherein said aperture element edge is configured to engage said bottle cap to facilitate removal of said bottle cap from said bottle.

15. The hanger system of claim 14, wherein said aperture element edge defines a mouth of said Tiki.

16. The hanger system of claim 15, wherein said aperture element edge comprises a flange which inwardly extends into said aperture element opening;

wherein said flange defines a portion of upper teeth within said mouth of said Tiki; and wherein said flange is configured to engage said bottle cap to facilitate removal of said bottle cap from said bottle.

17. The hanger system of claim 16, wherein said aperture element edge further comprises a fulcrum disposed opposite said flange;

wherein said fulcrum defines a portion of lower teeth within said mouth of said Tiki; and wherein said flange and said fulcrum are configured to engage said bottle cap to facilitate removal of said bottle cap from said bottle.

18. A hanger system comprising:

a body having opposing body first and second faces;

a hanger element removably coupled to said body;

wherein said hanger element comprises a hook which outwardly extends from said body;

wherein upon removal of said hanger element from said body, said hanger element is irreversibly detached from said body;

a first support element removably coupled to said body;

wherein upon removal of said first support element from said body, said first support element is irreversibly detached from said body; and an aperture element disposed within said body, said aperture element having an aperture element edge defining an aperture element opening which communicates between said body first and second faces;

wherein said aperture element opening is configured to receive at least a portion of a bottle cap removably coupled to a bottle; and wherein said aperture element edge is configured to engage said bottle cap to facilitate removal of said bottle cap from said bottle.

* * * * *